US007735468B2

(12) United States Patent
Tanimura et al.

(10) Patent No.: US 7,735,468 B2
(45) Date of Patent: Jun. 15, 2010

(54) ELECTRONIC THROTTLE DEVICE AND METHOD OF MANUFACTURING THE SAME

(75) Inventors: Hiroshi Tanimura, Kariya (JP); Tomiharu Isogai, Hekinan (JP)

(73) Assignees: DENSO CORPORATION, Kariya (JP); Aisan Kogyo Kabushiki Kaisha, Obu (JP)

( * ) Notice: Subject to any disclaimer, the term of this patent is extended or adjusted under 35 U.S.C. 154(b) by 345 days.

(21) Appl. No.: 12/068,698

(22) Filed: Feb. 11, 2008

(65) Prior Publication Data

US 2008/0236542 A1 Oct. 2, 2008

(30) Foreign Application Priority Data

Mar. 30, 2007 (JP) ..... 2007-092357

(51) Int. Cl.
*F02D 9/08* (2006.01)
*F16L 25/00* (2006.01)
*F02M 35/10* (2006.01)

(52) U.S. Cl. ..... 123/337; 123/184.61; 251/305; 285/330; 285/921

(58) Field of Classification Search ..... 123/184.21, 123/184.61, 337, 361, 399, 403; 285/231, 285/330, 348, 349, 382, 921; 251/304, 305
See application file for complete search history.

(56) References Cited

U.S. PATENT DOCUMENTS 2,912,262 A * 11/1959 Franck ..... 285/231
3,297,298 A * 1/1967 Sachnik ..... 251/316
4,008,298 A * 2/1977 Quantz ..... 261/44.3
4,505,863 A * 3/1985 Smith ..... 261/34.2
5,878,715 A * 3/1999 Hernandez et al. ..... 123/337
5,988,131 A * 11/1999 Hernandez et al. ..... 123/337
7,080,628 B2 7/2006 Kado et al.
2005/0034705 A1 * 2/2005 McClendon ..... 123/337

FOREIGN PATENT DOCUMENTS

JP 2002-295756 10/2002
JP 2006-46318 2/2006

* cited by examiner

*Primary Examiner*—Willis R Wolfe, Jr.
(74) *Attorney, Agent, or Firm*—Nixon & Vanderhye PC

(57) ABSTRACT

An electronic throttle device includes a throttle body, a bulge, and a ring. The throttle body includes a bore part having an approximately cylindrical shape. The bore part is connected to an upstream air hose such that the upstream air hose is located on an outside of the bore part and is fastened with a fastening member from an outside of the upstream air hose. The bulge is discontinuously located along an outer circumference of the bore part and has a groove along an outer circumference of the bulge. The ring has a cross-sectional dimension larger than a depth of the groove in a radial direction of the bore part, and is located into the groove to configurate a protruding part that protrudes radially outwardly and extends entirely on the outer circumference of the bore part.

10 Claims, 4 Drawing Sheets

ELECTRONIC THROTTLE DEVICE AND METHOD OF MANUFACTURING THE SAME

CROSS REFERENCE TO RELATED APPLICATION

This application is based on Japanese Patent Application No. 2007-92357 filed on Mar. 30, 2007, the content of which is incorporated herein by reference in its entirety.

BACKGROUND OF THE INVENTION

1. Field of the Invention

The present invention relates to an electronic throttle device and a method of manufacturing the same. More specifically, the present invention relates to a connection structure of the electronic throttle device.

2. Description of the Related Art

Conventionally, a vehicular engine includes an electronic throttle device having a throttle valve and a motor. An angle (i.e., opening degree) of the throttle valve is controlled by driving the motor in accordance with a pressing amount of an accelerator pedal pressed by a driver. The electronic throttle device includes a throttle body having a throttle bore part. The throttle bore part has an approximately cylindrical shape and has an inlet portion at one end thereof. An upstream air hose is located at an outside of the inlet portion of the throttle bore part, and is fastened to the inlet portion with a fastening member (e.g., a hose band) from an outside of the upstream air hose. The inlet portion of the throttle bore part has a bulge at its outer circumference, for improving a connecting force of a connecting part between the throttle bore part and the upstream air hose, and thereby an airtightness of the connecting part is improved and an air leakage is reduced. The electronic throttle device further includes a housing base for housing the motor therein, and the housing base is attached to the throttle body through the throttle bore part and a concave portion.

The throttle body is generally formed by die-casting with a two-cavity mold for improving a productivity. When the electronic throttle device is used for an engine having a turbocharger or a supercharger, the throttle bore part may receive a high positive pressure. Thus, when a part of the bulge is lacked, the connecting force between the throttle bore part and the upstream air hose may be insufficient to prevent an air leakage from the connecting part. Thereby, an accuracy of an intake-air control may be reduced, and an output and a fuel consumption of the vehicular engine also may be reduced.

JP-2002-295756A discloses a swivel-hose joint for being connected with a hose. The swivel-hose joint includes a joint body, a pipe body having one end connected with the hose and the other end inserted into the joint body, and a C-ring. The C-ring is disposed between the joint body and the pipe body, so that the pipe body is not pulled out from the joint body and the pipe body can smoothly rotate with respect to the joint body. This joint structure is designed so that the hose does not twist when the swivel-hose joint rotates. However, this joint structure is not designed for improving an airtightness and a connecting force between the swivel-hose joint and the hose, and/or preventing the hose from being pulled out from the swivel-hose joint.

SUMMARY OF THE INVENTION

In view of the foregoing problems, it is an object of the present invention to provide an electronic throttle device, a connection structure of the electronic throttle device, and/or a method of manufacturing the electronic throttle device.

According to a first aspect of the invention, an electronic throttle device includes a throttle body, a bulge, and a ring. The throttle body includes a bore part having an approximately cylindrical shape. The bore part is connected to an upstream air hose such that the upstream air hose is located on an outside of the bore part and is fastened with a fastening member from an outside of the upstream air hose. The bulge is discontinuously located along an outer circumference of the bore part and has a groove along an outer circumference of the bulge. The ring has a cross-sectional dimension larger than a depth of the groove in a radial direction of the bore part, and is located into the groove to configurate a protruding part that protrudes radially outwardly and extends entirely on the outer circumference of the bore part.

According to a second aspect of the invention, a connection structure of an electronic throttle device includes a throttle body, an upstream air hose, a fastening member, a bulge, and a ring. The throttle body includes a bore part having an approximately cylindrical shape. The upstream air hose is located on an outside of the bore part. The fastening member fastens the upstream air hose to the throttle body from an outside of the upstream air hose. The bulge is discontinuously located along an outer circumference of the bore part and has a groove along the outer circumference of the bulge. The ring has a cross-sectional dimension larger than a depth of the groove in a radial direction of the bore part, and is inserted into the groove to configurate a protruding part that protrudes radially outwardly and extends entirely on the outer circumference of the bore part.

According to a third aspect of the invention, a method of manufacturing an electronic throttle device includes: forming a groove along an outer circumference of a bulge simultaneously with forming the bulge discontinuously along an outer circumference of a bore part of a throttle body; and fitting a ring into the groove to configurate a protruding part that protrudes radially outwardly and extends entirely on the outer circumference of the bore part. The ring has a cross-sectional dimension larger than a depth of the groove in a radial direction of the bore part.

Because the protruding part is provided to extend entirely on the outer circumference of the bore part, the upstream air hose can be connected with the bore part with a high connecting-force and a high airtightness.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

First Embodiment

Figure 1A:
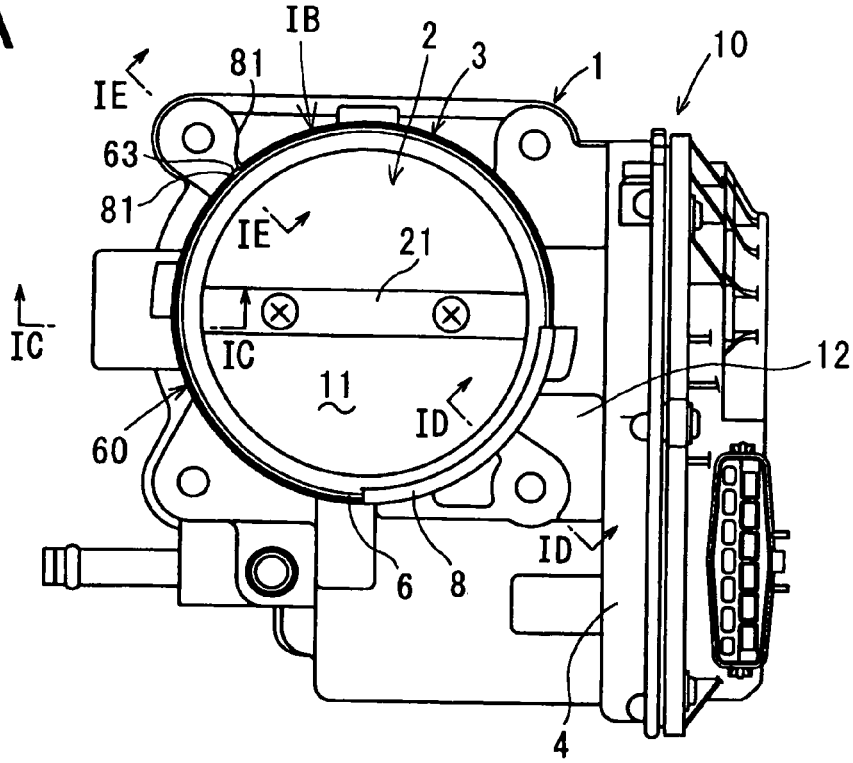
FIG. 1A is a plan view of an electronic throttle device according to a first embodiment of the invention.

An electronic throttle device 10 according to a first embodiment of the invention can be used for an intake pipe of a vehicular engine. As shown in FIG. 1A, the electronic throttle 10 includes a throttle body 1 having an intake-air passage 11. The intake-air passage 11 has an approximately circular shape in cross section. A rotating shaft 21 is disposed in the intake-air passage 11 to be held by the throttle body 1, and a valve 2 for controlling an opening degree of the intake-air passage 11 is attached to the rotating shaft 21. In a lower part of the throttle body 1, a driving motor (not shown) for rotating the valve 2 and an electronic unit (not shown) are housed. For example, the throttle body 1 may be made of aluminum alloy by die-casting. Alternatively, the throttle body 1 may be made of resin by injection molding.

Figure 1B:
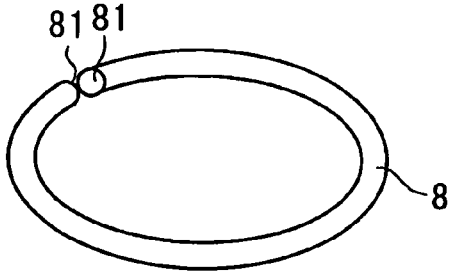
FIG. 1B is a perspective view of a C-ring according to the first embodiment.
Figure 1C:
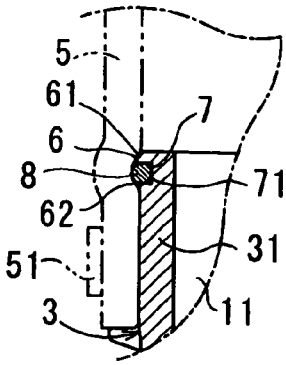
FIGS. 1C-1E are cross-sectional views showing different sections of a throttle bore part taken along lines IC-IC, ID-ID, and IE-IE in FIG. 1A, respectively.
Figure 1D:
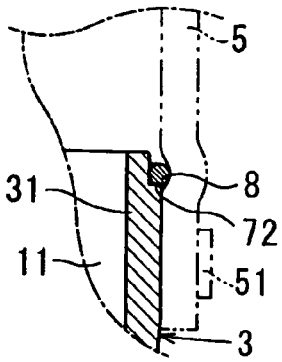
Figure 1E:
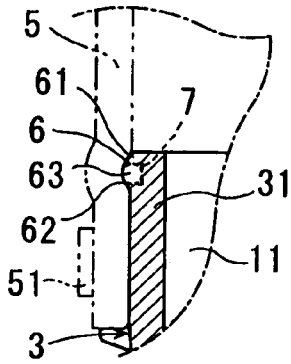
Figure 2A:
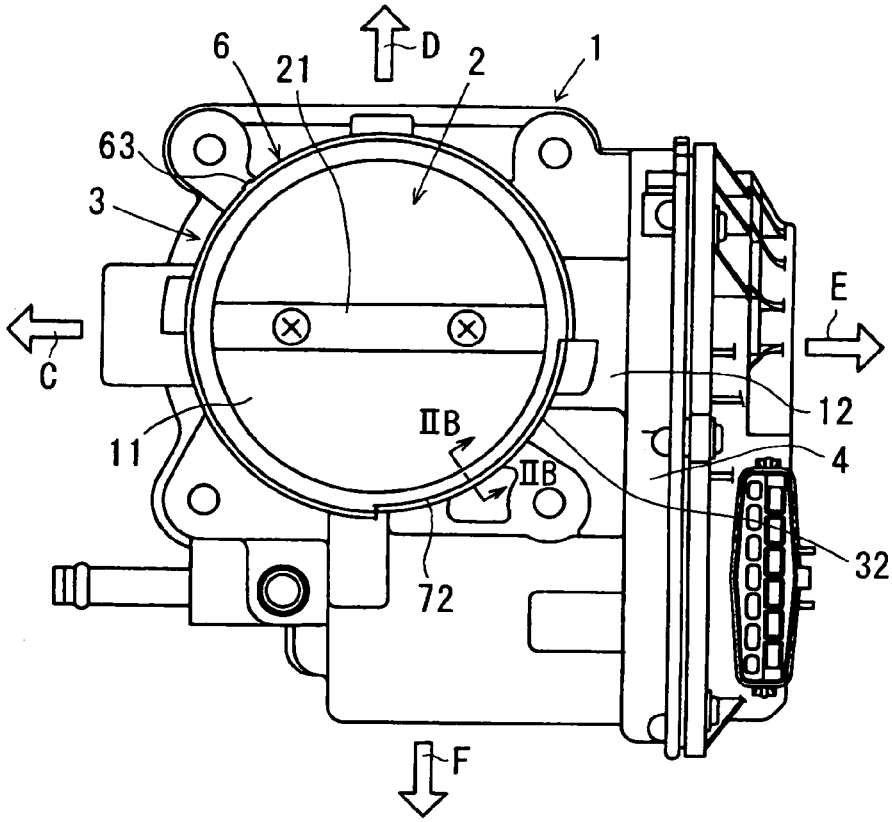
FIG. 2A is a plan view of a throttle body according to the first embodiment and FIG. 2B is a front view of the throttle body including a partial cross section IIA taken along a line IIB-IIB in FIG. 2A.
Figure 2B:
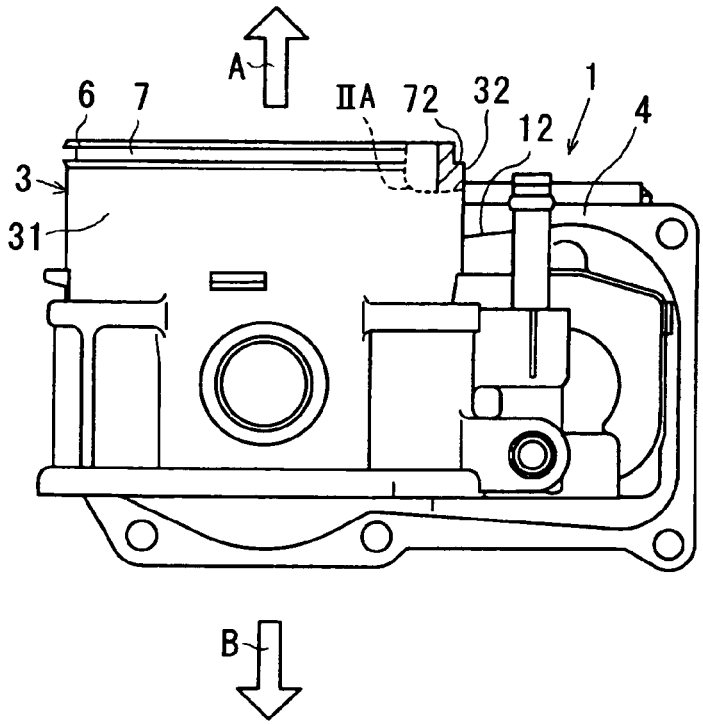

As shown in FIGS. 2A and 2B, the throttle body 1 includes a throttle bore part 3 having an approximately cylindrical shape and in which the intake-air passage 11 is provided, and a flange part 4 for housing valve-driving elements such as the driving motor and the electronic unit (not shown). As shown in FIG. 2B, an upper end portion of the throttle bore part 3 extends upwardly compared with the flange part 4, so as to provide an inlet portion 31 in the throttle bore part 3. As shown in FIGS. 1C-1E, an upstream air hose 5 is located at an outside of the inlet portion 31 and is fastened to the inlet portion 31 with a fastening band 51 from an outside of the upstream air hose 5. As shown in FIG. 2B, a concave part 12 (recess part) is provided between the throttle bore part 3 and the flange part 4 so that the upstream air hose 5 is attached using the space with the concave part 12.

When the throttle body 1 is formed by die-casting, a two-cavity mold is generally used for improving a productivity. In this case, split molds for forming one product cannot be removed in a direction toward the other product. For example, when the other product is arranged in a direction shown by the arrow F in FIG. 2A, the split molds can be removed only in the directions shown by the arrows A-E in FIGS. 2A and 2B, and cannot be removed in the direction shown by the arrow F. Additionally, because the cylindrical surface of the throttle bore part 3 can be provided only when a split mold for forming the concave portion 12 is removed in the direction shown by the arrow A, the split mold cannot be removed in the direction shown by the arrow E. Thus, a three-dimensional structure is difficult to be formed in the space of the concave portion 12 that faces the other product and is positioned between the throttle bore part 3 and the flange part 4. Thereby, a bulge 6 can be provided at only about 270-degree angle along an outer circumference of the inlet portion 31 of the throttle bore part 3, and a lacking portion 32 without the bulge 6 and having the same cylindrical surface with the inlet portion 31 is provided at about 90-degree angle.

Figure 5:
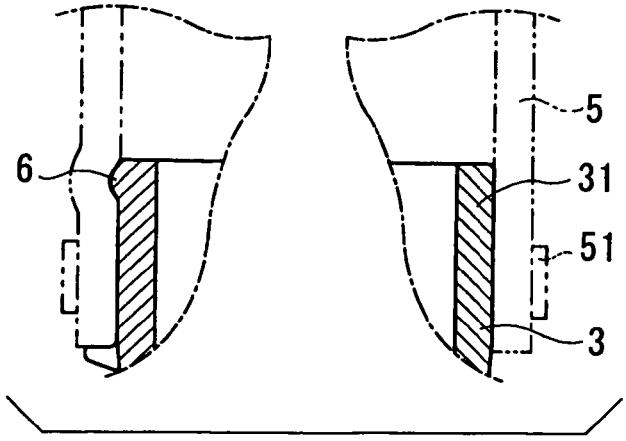
FIG. 5 is a cross-sectional view of a throttle bore part according to a comparative example.

In a comparative example shown in FIG. 5, a protruding part on the outer circumference of the inlet portion 31 is only provided by the bulge 6 that is discontinuously located along the outer circumference of the inlet portion 31. Thus, when the throttle bore part 3 receives a high positive pressure, a connecting force between the throttle bore part 3 and the upstream air hose 5 may be insufficient to prevent an air leakage from the connecting part. As a result, an accuracy of an intake-air control may be reduced, and an output and a fuel consumption efficiency of the vehicular engine also may be reduced.

The bulge 6 according to the first embodiment has an approximately half spindle shape in cross section, for example. Specifically, an upper end portion 61 of the bulge 6 has a gentle slope and a lower end portion 62 of the bulge 6 has a steep slope, as shown in FIG. 1C. Additionally, a groove 71 is provided at a middle portion of the bulge 6 along an outer circumference of the bulge 6. The groove 71 has an approximately rectangular shape in cross section, for example. At the lacking portion 32, a stepped section 72 is provided along the outer circumference of the inlet portion 31, so that the stepped section 72 and the groove 71 are connected with each other to provide a surrounding groove 7. For example, an upper side of the stepped section 72 is open as shown in the partial cross-sectional view IIA in FIG. 2B. The surrounding groove 7 may be formed simultaneously with the throttle body 1 by molding. On the surrounding groove 7, a C-ring 8 is fitted. The C-ring 8 has a discontinuous ring shape having a cut portion as shown in FIG. 1B. Additionally, the C-ring 8 has an approximately circular shape in cross section and a diameter of the circular shape, i.e., a cross-sectional dimension of the C-ring 8 in a radial direction of the throttle bore part 3, is larger than a depth of the surrounding groove 7. The C-ring 8 may be made of metal or resin, for example. By fitting the C-ring 8 on the surrounding groove 7, a protruding part 60 that protrudes radially outwardly and extends entirely on an outer circumference of the inlet portion 31 is formed without a machining process. When the bulge 6 is thin, the stepped section 72 in the surrounding groove 7 is not required. That is, the entirely-circumferential protruding part 60 is constituted with the C-ring 8 fitted on the surrounding groove 7.

For example, a width of the surrounding groove 7 can be set so that the C-ring 8 is fitted with the surrounding groove 7 smoothly and tightly. As shown in FIGS. 1A and 1E, the surrounding groove 7 is not formed at a middle portion of the bulge 6 in a circumferential direction, and thereby a retaining wall 63 protruding radially outwardly is formed at the middle portion. The retaining wall 63 is located to provide a part of the entirely-circumferential protruding part 60. The C-ring 8 is fitted on the surrounding groove 7 so that two circumferential end portions 81 of the C-ring 8 contact the retaining wall 63, and thereby the C-ring 8 is prevented from rotating. Thus, the cut portion of the C-ring 8 does not overlap the lacking portion 32 and a seal property of the entirely-circumferential protruding part 60 does not reduced due to the cut portion of the C-ring 8. The depth of the surrounding groove 7 (i.e., groove 71) in the bulge 6 can be equal to or more than a half of the cross-sectional dimension of the C-ring 8 so that the C-ring 8 can be stably held by the surrounding groove 7. A cross-sectional shape of the surrounding groove 7 is not limited to the rectangular shape shown in FIG. 1C. For example, the surrounding groove 7 may have an approximately U-shape in cross section.

Because the entirely-circumferential protruding part 60 is provided at the outer circumference of the inlet portion 31 of the throttle bore part 3, the connecting force and the airtightness between the throttle body 1 and the upstream air hose 5 are increased. Furthermore, the C-ring 8 can be easily deformed and fitted on the surrounding groove 7. Thus, the entirely-circumferential protruding part 60 is formed easily without a machining process such as cutting.

Second Embodiment

Figure 3A:
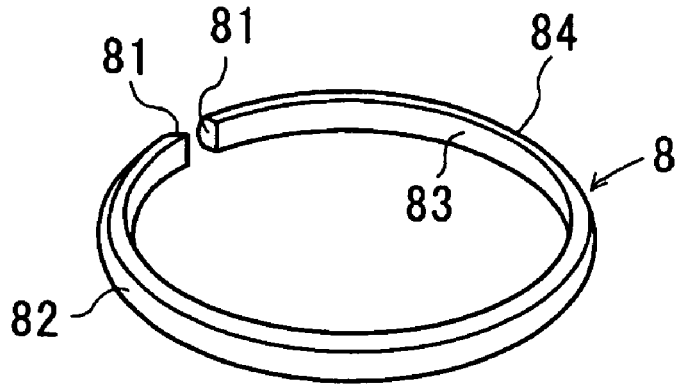
FIG. 3A is a perspective view of a C-ring.
Figure 3B:
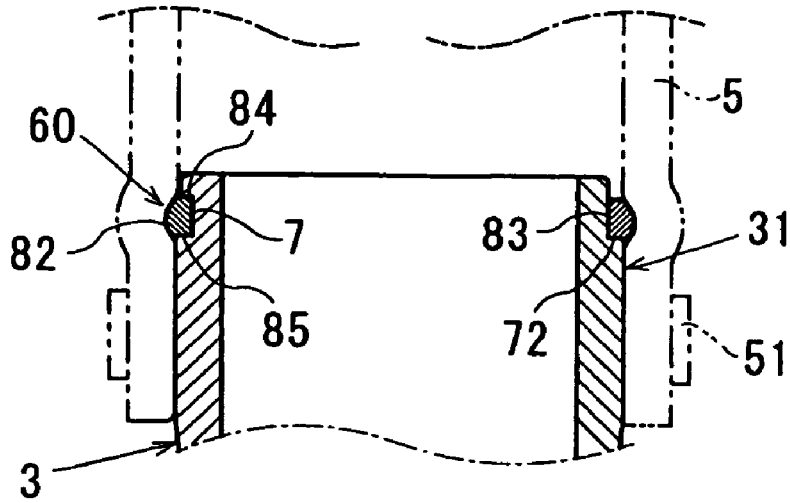
FIG. 3B is a cross-sectional view of a throttle bore part, according to a second embodiment of the invention.

A C-ring 8 according to a second embodiment of the invention has an irregular rectangular shape in cross section, as shown in FIGS. 3A and 3B. Specifically, an outer peripheral surface 82 of the C-ring 8 has an approximately half spindle sectional shape, and each of an inner peripheral surface 83, an upper surface 84, and a lower surface 85 has an approximately linear sectional shape in a cross section shown in FIG. 3B. The surrounding groove 7 has a rectangular cross-sectional shape corresponding to the shapes of the inner peripheral surface 83, the upper surface 84, and the lower surface 85. In the electronic throttle device 10 according to the second embodiment, similar effects with those of the first embodiment can be obtained. Additionally, the C-ring 8 can be stably held in the surrounding groove 7, and a stability and a durability of the entirely-circumferential protruding part 60 can be improved.

Third Embodiment

Figure 4A:
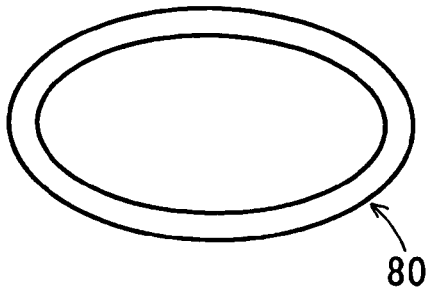
FIG. 4A is a perspective view of an O-ring.
Figure 4B:
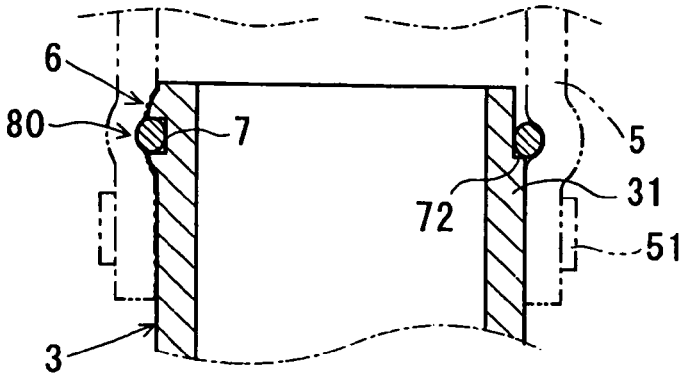
FIG. 4B is a cross-sectional view of a throttle bore part, according to a third embodiment of the invention.

In an electronic throttle device 10 according to a third embodiment of the invention, as shown in FIGS. 4A and 4B, an O-ring 80 having a continuously extending ring shape is fitted on the surrounding groove 7 instead of the C-ring 8 shown in FIGS. 1B and 3A. In this case, the retaining wall 63 shown in FIGS. 1A and 1E is not provided in the bulge 6. For example, the O-ring 80 has an approximately circular shape in cross section similarly with the C-ring 8 shown in 1B, and a diameter of the circular shape, i.e., a cross-sectional dimension of the O-ring 80 in a radial direction of the throttle bore part 3, is larger than the depth of the surrounding groove 7.

When the O-ring 80 is used instead of the C-ring 8, the productivity of the electronic throttle device 10 can be improved by using a pressing device, and the airtightness and the durability of the entirely-circumferential protruding part 60 also can be improved.

Alternatively, the O-ring 80 may have an approximately irregular rectangular shape in cross section similarly with the C-ring 8 shown in 3A. Specifically, an outer peripheral surface of the O-ring 80 may have an approximately half spindle sectional shape, and each of an inner peripheral surface, an upper surface, and a lower surface of the O-ring 80 may have an approximately linear sectional shape in a cross section.

In this case, the O-ring 80 can be stably held in the surrounding groove 7, and the stability and the durability of the entirely-circumferential protruding part 60 can be improved.

Such changes and modifications are to be understood as being within the scope of the present invention as defined by the appended claims.

What is claimed is:

1. An electronic throttle device for being connected with an upstream air hose, comprising:

a throttle body including a bore part having an approximately cylindrical shape, the bore part being connected to the upstream air hose such that the upstream air hose is located on an outside of the bore part and is fastened with a fastening member from an outside of the upstream air hose;

a bulge discontinuously located along an outer circumference of the bore part and having a groove along an outer circumference of the bulge; and a ring having a cross-sectional dimension larger than a depth of the groove in a radial direction of the bore part, and located into the groove to configurate a protruding part that protrudes radially outwardly and extends entirely on the outer circumference of the bore part.

2. The electronic throttle device according to claim 1, wherein:

the ring is an O-ring that has a continuous ring shape.

3. The electronic throttle device according to claim 1, wherein:

the ring is a C-ring that has a discontinuous ring shape having a cut portion.

4. The electronic throttle device according to claim 3, wherein:

the bulge has a retaining wall having a cross-sectional shape similar to the protruding part, at a portion of the groove; and the C-ring is disposed so that two circumferential end portions of the C-ring contact the retaining wall.

5. A connection structure of an electronic throttle device, comprising:

a throttle body including a bore part having an approximately cylindrical shape;

an upstream air hose located on an outside of the bore part;

a fastening member for fastening the upstream air hose to the throttle body from an outside of the upstream air hose;

a bulge discontinuously located along an outer circumference of the bore part and having a groove along an outer circumference of the bulge; and a ring having a cross-sectional dimension larger than a depth of the groove in a radial direction of the bore part, and inserted into the groove to configurate a protruding part that protrudes radially outwardly and extends entirely on the outer circumference of the bore part.

6. The connection structure according to claim 5, wherein:

the groove is located at an axial end portion of the bore part;

the bore part has a stepped section in cross section at the end portion without the bulge;

the ring is located to be fitted into the groove and the stepped section to configurate the protruding part inside of the upstream air hose.

7. A method of manufacturing an electronic throttle device that includes a throttle body having a bore part and a bulge discontinuously provided along an outer circumference of the bore part, the method comprising:

forming a groove along an outer circumference of the bulge simultaneously with forming the bulge; and fitting a ring into the groove to configurate a protruding part that protrudes radially outwardly and extends entirely on the outer circumference of the bore part, wherein the ring has a cross-sectional dimension larger than a depth of the groove in a radial direction of the bore part.

8. The method according to claim 7, wherein:

the ring includes an O-ring that has a continuous ring shape; and the O-ring is pressed into the groove to configurate the protruding part.

9. The method according to claim 7, wherein:

the groove is simultaneously formed with the throttle body; and the ring is a C-ring that has a discontinuous ring shape having a cut portion.

10. The method according to claim 9, further comprising:

forming a retaining wall having a cross-sectional shape similar to the protruding part, at a portion of the groove, wherein:

the C-ring is fitted into the groove so that two circumferential end portions of the C-ring contact the retaining wall to configurate the protruding part.

* * * * *